US006541441B2

(12) United States Patent
Mumoli

(10) Patent No.: US 6,541,441 B2
(45) Date of Patent: Apr. 1, 2003

(54) SINGLE-DOSE SOAP UNIT AND METHOD

(76) Inventor: Jose Alejandro Mumoli, Hugo Zeyen 6234, Dto 13, Buenos Aires, 1684 cj El Palomar (AR)

( * ) Notice: Subject to any disclaimer, the term of this patent is extended or adjusted under 35 U.S.C. 154(b) by 76 days.

(21) Appl. No.: 09/725,975

(22) Filed: Nov. 29, 2000

(65) Prior Publication Data

US 2001/0049345 A1 Dec. 6, 2001

(51) Int. Cl.[7] ..... C11D 17/00

(52) U.S. Cl. ..... 510/446; 510/141; 510/444; 510/445; 510/447; 510/290; 510/298

(58) Field of Search ..... 510/141, 444, 510/445, 446, 447, 290, 298

(56) References Cited

U.S. PATENT DOCUMENTS 5,529,788 A * 6/1996 DeSenna ..... 424/466

5,817,337 A * 10/1998 DeSenna ..... 424/466

* cited by examiner

*Primary Examiner*—Charles Boyer

(74) *Attorney, Agent, or Firm*—Merchant & Gould P.C.

(57) ABSTRACT

The invention provides a single-dose soap for use only once, as a disposable soap unit, the soap unit having a high solubility in order to be quickly dissolved during a washing operation, the soap unit comprising lauryl sodium sulfate, a first hydrophilic disintegrating agent, an agglutinating agent, and a second hydrophilic disintegrating agent for causing a sudden disintegration and dissolution of the soap when contacting with a liquid for the washing operation. The invention also provides a method for manufacturing the soap unit.

24 Claims, 1 Drawing Sheet

SINGLE-DOSE SOAP UNIT AND METHOD

BACKGROUND OF THE INVENTION

1. Field of the Invention

The present invention relates to the field of cleaning elements and, more particularly refers to a soap mixture for use in personal cleaning, such as a toilet soap, and even more preferably the invention relates to a soap unit to be used only once, that is as a disposable unit in a format and dose enough for use a s soap bar, shampoo, hair conditioner and any other cleaning and cleansing element for personal, domestic or industrial application.

2. Description of the Prior Art

For several number of years several formats and shapes have been used for various kinds of soaps used for personal applications and other uses in the domestic and industrial areas. The formats and presentation of these products have always been the results of studies related to the particular use of the soap, that is in liquid, powder and solid formulations.

According to the practice, a soap is a past resulting from the combinaton of an alkali with oil acids and other fatty components. In the pharmaceutical field, a soap is a combination of ammonium or another alkali or a metal oxide of oils, fatty components and resins. In soft soaps the alkali is the potash and in hard soaps he alkali is the soda ash. Some typical formulae for soaps used for hygiene are as follows:

| | |
|---|---|
| Washing Soap (White): | |
| White Tallow (100%) | 97.00 wt %; |
| Optic White Agent | 0.02 wt %; |
| Edta Disodium | 2.00 wt %; |
| Perfume Essence | excp; |
| Etoxilated Fatty Alcohol (Lauryl) (nonionic surfactant); | |
| Sodium Alkylsulfanate (anionic surfactant); | |
| Sodium soap; | |
| Water softening; | |
| Biologic catalyst; | |
| Glazing Agent; | |
| Perfumes. | |
| Hair Conditioner: | |
| Demineralized Water; | |
| Cetrimonium Chloride; | |
| Zetil-Alcohol; | |
| Essence; | |
| Metyl Chloroisotiazolinone; | |
| Metyl Isotyazolinone; and | |
| Citric Acid. | |
| Toilet Soap: | |
| Modified Coconut Detanolamide | 0.50 wt %; |
| Anhydrous Lanoline | 1.00 wt %; |
| Disodium Edta | 0.03 wt %; |
| Perfume | 1.20 wt %; |
| Whitened Soap Pellets (bovine tallow) | 97.27 wt %; |
| Coconut Tallow. | |
| Shampoo: | |
| Demineralized Water | 62.47 wt %; |
| Glycerin | 0.70 wt %; |
| Sodium Etoxi Sulfate Lauryl (25%) | 28.00 wt %; |
| Flamatenso (Cocoamide Propil Beteme) | 3.00 wt %; |
| Modified Coconut Dietanolamide | 3.00 wt %; |
| Disodium Edta | 0.10 wt %; |
| Citric Acid | 2.00 wt %; |
| Bright Red 4R | 0.01 wt %; |
| Bactekill 2001 (50%) | 0.3 wt %; |

-continued

| | |
|---|---|
| Sandalwood Alcoholic Extract | 0.05 wt %; |
| Other Perfumes exc. | 0.35 wt %. |

While the above formulae have been in use during a considerable number of years, some formats and presentations have been modified according to the modern market demands. In the particular case of the toilet soap bars, the same have been commercialized in larger or smaller pieces of soap, but always such units had a size enough to use the soap bar for several times. While all these soap bars have been designed for personal use, these bars are exposed to the use by many different persons either in the house, or in worse conditions, in public locations, such as toilets or bathrooms at restaurants, gas stations, etc. It is quite common to find a soap bar of this type with many impurities like dirty, down, hair and other undesired elements. While the bar is found in solid state, dry and with consistency enough to be used, the people is reluctant to use the soap bar in the above dirty conditions and, generally, the soap bar is disposed even with an almost entire original size, that is with a little use. In other words, the soap is wasted prematurely because of its appearance.

Other cleansing products such as the shampoos and hair conditioners are commercialized in large and non practical containers which, in addition to the inconveniences of these containers in their use, the same are spoilage and dangerous agents for the environment when empty. Some times, the cost of the container reaches the cost of the contained product and, even if special caps are fitted in the container few possibilities of metering the content are provided for the consumer. Generally, when used by children or in baths at sport clubs, hotels and other public places, the product is remarkably wasted such as poured onto the floor, used unnecessarily in excess, etc.

In view of the above drawbacks, it would be therefore convenient to have a kind of soap, shampoo, hair conditioner or any other cleansing product, preferably a personal toilet product, capable of providing a personal unit with a small size, to be used once and disposed without waste of the product. Even if a person skilled in the art would think the question is easily resolved by making a soap bar or cleansing product as small as possible to only cover the needs of an individual during a hands washing operation or a shower, this attempt has been shown not a solution to this problem as long as too much time must be awaited for until such presumable soap bar is dissolved in the hands, over the human body or in any other application.

It would therefore be desirable to find such a small soap unit capable of being applied, preferably, in personal hygiene and having a high capacity to be quickly dissolved in a washing or cleansing operation.

SUMMARY OF THE INVENTION

It is therefore an object of the present invention to provide a single-dose soap for use only once, as a disposable soap unit, the soap unit having a high solubility in order to be quickly dissolved during a washing operation, the soap unit comprising lauryl sodium sulfate, a first hydrophilic disintegrating agent, an agglutinating agent, and a second hydrophilic disintegrating agent for causing a sudden disintegration and dissolution of the soap when contacting with a liquid for the washing operation. The invention also provides a method for manufacturing the soap unit.

It is also an object of the present invention to provide a singledose soap for use only once, as a disposable soap unit, the soap unit having a high solubility in order to be quickly dissolved during a washing operation, the soap unit comprising lauryl sodium sulfate, a surfactant agent, an agglutinating agent, and croscaramellose, an hydrophilic disintegrating agent for causing a sudden disintegration and dissolution of the soap when contacting with a liquid for the washing operation. The invention also provides a method for manufacturing the soap unit.

It is still another object of the present invention to provide single-dose soap body, the soap body having a high solubility in order to be quickly dissolved in a liquid for washing operation, the soap body comprising about 35 wt % to about 98 wt % lauryl sodium sulfate with a 98% purity, a softener agent, and magnesium estearate.

It is still another object of the present invention to provide single-dose soap body, the soap body having a high solubility in order to be quickly dissolved in a liquid for washing operation, the soap body comprising about 15 wt % to about 25 wt % lauryl sodium sulfate with a 98% purity, about 8 wt % to about 15 wt % of croscaramellose, and/or corn starch.

It is a further object of the present invention to provide a method of manufacturing a single-dose solid soap body with increased solubility, the soap body being quickly dissolved in a washing operation, the method comprising:

a) forming a mixture by mixing the following powder components:
   about 15 wt % to about 25 wt % lauryl sodium sulfate,
   about 15 wt % to about 20 wt % of a first hydrophilic disintegrating agent, an agglutinating agent, and
   about 50 wt % to about 60 wt % of a second hydrophilic disintegrating agent, the second disintegrating agent causing a sudden disintegration and dissolution of the body upon subject the body to said washing operation.

It is even another object of the present invention to provide the above mentioned method, wherein the components are compressed from a powder form and agglutinated into a compact and quick soluble solid soap body, such as a solid bar, a solid tablet, a solid pill, solid pellets, solid lozenges, ovules and capsules.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

As stated above many different formats and sizes of soaps have been commercialized but none of them have been manufactured to be disposed without waste after a single use, preferably a single personal hygiene use. The soap unit according to the invention is quickly dissolved to allow the consumer to use the soap unit without having to await for a time until the soap mass is dissolved; on the contrary, the inventive soap is suddenly disintegrated or dispersed upon a minimum washing action in a liquid medium. The inventive soap is based in natural agglutinants, cleaning agents and softeners, instead of using the typical tallows, sodium and coloring agents.

Natural agglutinants, such as gum arabic provides the inventive soap unit with a higher dilution capacity as compared to typical soap formulation; and the cleaning agents may comprise 98 wt % purity powdered sodium sulfate lauryl (surfactant agent), and the softeners may comprise corn starch with a 4% content of humidity and magnesium stearate for an inventive toilet soap unit. A shampoo formulation according to the invention may comprise 35 wt % powdered sodium sulfate lauryl as a cleaning agent, and softeners like corn starch with a 4% content of humidity and magnesium stearate and glycerin of USP/FA quality. Generally according to the invention, all these components are in powdered and dry form and agglutinated, compressed, sifted and/or packaged or encapsulated according to the method of the invention.

Figure 4:
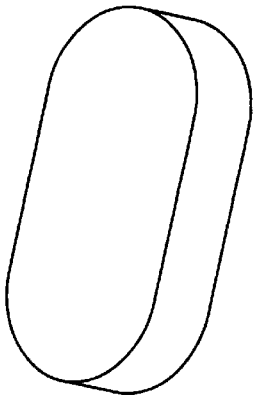
FIG. 4 shows a top perspective view of a soap unit according to a fourth embodiment incorporating the concepts of the invention.
Figure 3:
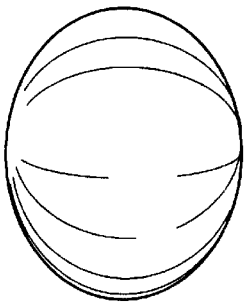
FIG. 3 shows a top perspective view of a soap unit according to a third embodiment incorporating the concepts of the invention.
Figure 2:
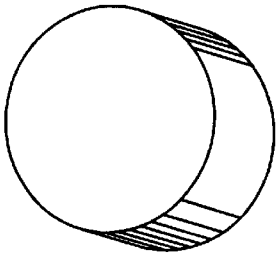
FIG. 2 shows a top perspective view of a soap unit according to a second embodiment incorporating the concepts of the invention.
Figure 1:
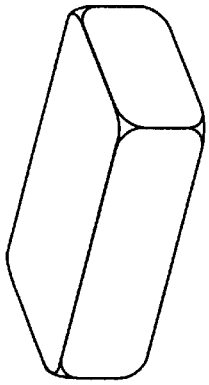
FIG. 1 shows a top perspective view of a soap unit according to a first embodiment incorporating the concepts of the invention.

As it is illustrated in the accompanying drawings, the soap unit of the invention may comprise a square block as shown in FIG. 1, a cylinder shown in FIG. 2, a an ovule with a wet core And an outer gel, preferably solid, cover or lining, or a varied shape like in FIG. 4. Each unit 1 of the invention may be packaged in unitary blister 2 like the one of FIG. 5, with a semi-rigid support 3 and a peelable cover 4, or in a multiple blister 5, illustrated in FIG. 6, which is provided in a box 6. The units may also be packaged in individual boxes, in dispensers or bulky in boxes.

According to a generic concept of the invention all the components of the soap unit are in powder form. If it is necessary the powders are sifted to have a uniform granulometry. The components are pre-mixed and mixed before subjecting the same to a compressing step.

A preferred formulation for the soap unit of the invention comprises about 15 wt % to about 25 wt % lauryl sodium sulfate (surfactant agent), about 15 wt % to about 20 wt % of a first hydrophilic disintegrating agent, an agglutinating agent, and about 50 wt % to about 60 wt % of a second hydrophilic disintegrating agent. The first hydrophilic disintegrating agent comprises about 15 wt % to about 25 wt % croscaramellose and the second hydrophilic disintegrating agent comprises about 50–60 wt % micro-crystalline cellulose. The second disintegrating agent causes a sudden disintegration and dissolution of the body upon contacting the soap body with a liquid medium, for example, water for a washing operation. Preferably, all the components are compressed from a powder form and agglutinated into a compact and quick soluble solid soap body. The above formulation also may comprise about 0.5 to 3.5 wt % of at least one colorant essence and perfume, and about 0.5 wt % to 1.5 wt % of at least one bactericide agent. The essence/colorant may be selected from index No. 19140, index No. 42090 or index No. 14700.

Even according to a more preferred alternative of the invention, the soap comprisies about 20 wt % lauryl sodium sulfate (98%), about 20 wt % croscaramellose as the first hydrophilic disintegrating agent, about 50 to 60 wt % Avicel PH200 (micro-crystalline cellulose) as the second hydrophilic disintegrating agent, about 1 wt % of at least one coloring essence, and about 0.5 wt % of at least one bactericide.

A single-dose solid soap of the invention comprises about 35 wt % to about 98 wt % lauryl sodium sulfate, a softener agent, and magnesium stearate. When the concepts of the invention are applied to a shampoo or hair conditioner, the soap preferably comprises about 10 to 20 wt % lauryl sodium sulfate with a purity of 98%, a softener agent, magnesium stearate, coconut fatty acids alkylolamide, and glycerin USP-FA quality. The softener agent preferably is corn starch with a 4% humidity content and the bactericide is not necessary.

The proportions and components may be adjusted to manufacture a soap unit such as a solid bar, a solid tablet, a solid pill, solid pellets, solid lozenges and capsules, as well as any other unit with a desired form, shape and size according to the particular application of the soap. Alternatively, a desired formulation form comprises an ovule having a wet interior and an outer gel cover.

In the above mentioned formulations, the agglutinating agent preferably comprises gum arabic and the product also may comprise surfactant components, co-surfactant components, adjuvant agents, antistatic agents, fragrances, dies aid opacity agents. More preferably, the product comprises about 0.2 wt % to about 1.5 wt % of a wetting adjuvant agent such as vegetal amides, cold cream, lanoline, silicone and its derivatives.

Sometimes the formulation needs a lubricating agent such as colloidal silica dioxide for improving the disintegration of the product in the compression process.

According to another aspect of the invention, a method of manufacturing a single dose soap unit with increased solubility, is provided. The method comprises:

a) forming a mixture by mixing the following powder components:
   about 15 wt % to about 25 wt % lauryl sodium sulfate,
   about 15 wt % to about 20 wt % of a first hydrophilic disintegrating agent,
   an agglutinating agent, and
   about 50 wt % to about 60 wt % of a second hydrophilic disintegrating agent, the second disintegrating agent causing a sudden disintegration and dissolution of the body upon subject the body to said washing operation. According to a preferred embodiment of the method, the above mixture is compressed and/or agglutinated and conformed into small solid soap bodies. The compression may be carried out at a pressure of 3–7 Kg/cm$^2$ and more preferably at a pressure of 4–6 Kg/cm$^2$. Before compression, the mixture may be sifted. According to the set of puncheons used in the compressing machine is also important that the hardness of the small solid soap is obtained between 80 to 90 Newton/square inch.

Figure 6:
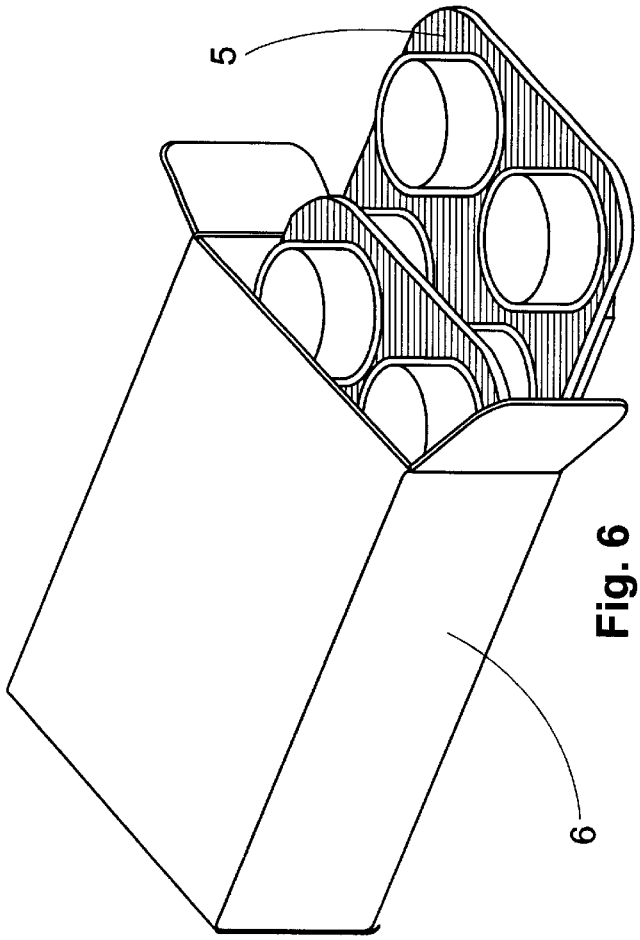
FIG. 6 shows a top perspective view of another alternative packaging also incorporating the concepts of the invention.
Figure 5:
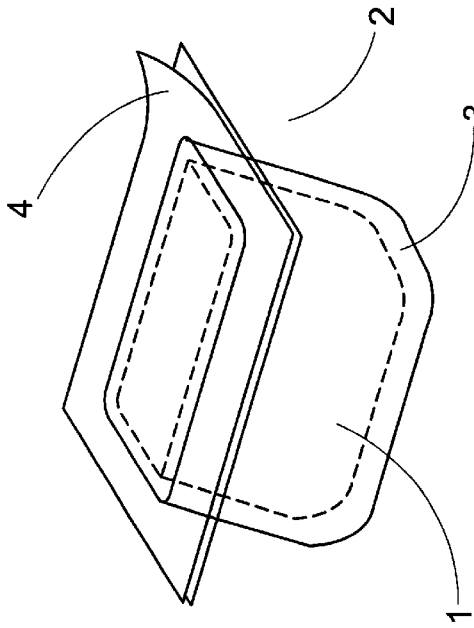
FIG. 5 shows a top perspective view of a packaging of the soap unit, according to a first embodiment incorporating the concepts of the invention.

In above step a) also wetting agents and over-greasing agents may be added to form pills for use as shampoo or hair conditioner. Alternatively the powdered mixture may be encapsulated into single-dose capsules. In connection with most of the formulations, the inventive soap units may be packaged into individual or multiple blisters as shown in FIGS. 5 and 6.

One or more bactericides, preferably Triclosan, is used for hygienic protection or for neutralizing the product.

The single-dose presentation as a pill, pastille, capsule, ovule, "dragee" or tablet in a packaging of the type of a light blister or a skin pack, some times recyclable, is an important advantage of the inventive product as compared to typical products, the package being small, light and not spoiling for the environment. In addition, the packaging according to the invention is easily portable, ideal for use in domestic applications, sport clubs, public and private offices, trips, camping, etc. without generating undesired wastes of the product.

EXAMPLE 1

The following soap composition has been prepared

| | |
|---|---|
| Sodium Sulfate Lauryl | 80 mg. |
| Croscaramellose | 80 mg. |
| Essence/color | 4 mg. |
| Crospovidone or Avisel | 234 mg. |
| Bactericide | 2 mg. |
| Enough Quantity for excp. | |

EXAMPLE 2

The following composition has been prepared:

| | |
|---|---|
| Lauryl Sodium Sulfate - Surfactant | 15–25 wt %. |
| Micro-crystalline cellulose (Avicel PH200), Disintegrating excp. | 50–60 wt %. |
| Sodium Crosscaramellose-disintegrating | 4–10 wt %. |
| Corn Starch - disintegrating | 4–10 wt %. |
| Polyvinyl pyrrolidone, agglutinant/stabilizer | 3–10 wt %. |
| Colloidal Silica Dioxide (talc), Inter-granule lubricant | 0.5–5 wt %. |
| Triclosan/Irgasan - Bactericide | 0.5–3 wt %. |
| Magnesium stearate - Lubricant | 0.5–2 wt %. |
| Essence/perfume/colorant | 0.5–3 wt %. |

All the components were compressed in a compressing machine at 3455 joule/cm2.

The hardness was controlled during the manufacture within a rate of 75 a 85 Newton/square inch. Thus, tablets or pills from compressed powdered were obtained for personal hygiene, which were single-dose, with high solubility and disintegration capability (soap pills). In the case of shampoo or hair conditioners it may be necessary to reduce the proportion of lauryl sodium sulfate, to eliminate the bactericide and add silicone derivatives, such as dimethyl polysiloxano, lanoline such as deodorized anhydrous lanoline.

The essences may be perfumes and colorants.

| | |
|---|---|
| Colorants | 0.5–1 wt %. |
| Perfumes | 0,5–2 wt %. |

The weight of the soap, shampoo and hair conditioner units according to the invention, were preferably between 100 mg. and 24 grs.

While preferred embodiments of the present invention have been illustrated and described, it will be obvious to those skilled in the art that various changes and modifications may be made therein without departing from the scope of the invention as defined in the appended claims.

I claim:

1. A single-dose cleansing product, the cleansing product having a high solubility in order to be quickly dissolved in a liquid medium for washing operation, the cleansing product comprising:

about 15 wt % to about 35 wt % sodium lauryl sulfate;

about 15 wt % to about 25 wt % of croscaramellose;

an agglutinating agent; and about 50 wt % to about 60 wt % of micro-crystalline cellulose, wherein said croscaramellose functions as a first hydrophilic disintegrating agent, and said micro-crystalline cellulose functions as a second hydrophilic disintegrating agent, the second disintegrating agent causing a sudden disintegration and dissolution of the unit upon contacting the cleansing product with said liquid medium for the washing operation.

2. The single-dose cleansing product of claim 1, wherein the components are compressed from a powder form and agglutinated into a compact and quick soluble solid single-dose cleansing product.

3. The single-dose cleansing product of claim 1, further comprising:

about 1 wt % of at least one colorant essence, and about 0.5 wt % of at least one bactericide agent.

4. The single-dose cleansing product of claim 1, comprising:

about 20 wt % lauryl sodium sulfate with a 98% purity;

about 20 wt % croscaramellose as the first hydrophilic disintegrating agent;

about 58.5 wt % micro-crystalline cellulose as the second hydrophilic disintegrating agent;

about 1 wt % of at least one coloring essence; and about 0.5 wt % to about 3 wt % of at least one bactericide.

5. The single-dose cleansing product of claim 4, wherein all the components are agglutinated from a powder form.

6. The single-dose cleansing product of claim 1, comprising a body that is for only one personal use selected from the group consisting of a solid bar, a solid tablet, a solid pill, solid pellets, solid lozenges and capsules.

7. The single-dose cleansing product of claim 1, wherein the agglutinating agent is selected from the group consisting of gum arabic and poly vinyl pyrrolidone.

8. The single-dose cleansing product of claim 1, further comprising at least one component chosen from the group consisting of: surfactant components, co-surfactant components, adjuvant agents, antistatic agents, fragrances, dies and opacity agents.

9. The single-dose cleansing product of claim 1, further comprising about 0.2 wt % to about 1.5 wt % of a wetting adjuvant agent selected from the group consisting of vegetal amides, cold cream, lanoline, silicone, derivatives of silicone, and mixtures thereof, wherein the single-dose cleaning product is used as shampoo or hair conditioner.

10. The single-dose cleansing product of claim 9, wherein the lanoline is deodorized anhydrous lanoline and the silicone is dimethyl polysiloxane.

11. The single-dose cleansing product of claim 1, comprising an ovule with a wet interior and an outer gel cover.

12. A method of manufacturing a single-dose cleansing product with an increased solubility for being quickly dissolved in a washing operation, the method comprising:

a) forming a mixture by mixing the following powder components:

about 15 wt % to about 35 wt % lauryl sodium sulfate, about 15 wt % to about 25 wt % of croscaramellose as first hydrophilic disintegrating agent, an agglutinating agent, and about 50 wt % to about 60 wt % of micro-crystalline cellulose as second hydrophilic disintegrating agent, the second disintegrating agent causing a sudden disintegration and dissolution of the cleansing product upon contacting the cleansing product with said liquid medium for the washing operation.

13. The method of claim 12, further comprising the step b) of compressing the mixture and conforming the same into small solid single-dose cleansing product.

14. The method of claim 13, further comprising the step of sifting the mixture before the compressing step.

15. The method of claim 13, wherein the compressing step is carried out at a pressure of 3–7 $Kg/cm^2$.

16. The method of claim 13, wherein the compressing step is carried out at a pressure of 4–6 $Kg/cm^2$.

17. The method of claim 12, wherein step a) further comprises adding wetting agents and over-greasing agents and forming pills for use as a shampoo or hair conditioner.

18. The method of claim 17, wherein the over-greasing agents comprise 1.2 wt % to 5 wt % of colloidal silica dioxide.

19. The method of claim 12, further comprising the step of encapsulating the mixture into single-dose capsules.

20. The method of claim 12, further comprising the step of forming single-dose units and packaging the same into blisters.

21. The method of claim 12, further comprising the step of forming single-dose units and packaging the same into individual boxes.

22. The method of claim 12, further comprising the step of forming single-dose units and packaging the same into a dispenser.

23. The method of claim 12, further comprising the step of forming single-dose units and packaging the same into bulk boxes.

24. The single-dose cleansing product of claim 1, further comprising a softener agent as corn starch, colloidal silica dioxide, magnesium stearate, coconut fatty acids, alkylolamide, glycerin and mixture thereof, when the single-dose cleansing product is used as shampoo or hair conditioner.

* * * * *